US011421493B2

(12) United States Patent
He et al.

(10) Patent No.: US 11,421,493 B2
(45) Date of Patent: Aug. 23, 2022

(54) DEVICE AND METHOD FOR TRANSFERRING AND STORING A DEEP IN-SITU CORE IN A SEALED AND PRESSURE-MAINTAINING MANNER

(71) Applicant: Institute of Geology and Geophysics, Chinese Academy of Sciences, Beijing (CN)

(72) Inventors: Jianming He, Beijing (CN); Zhaobin Zhang, Beijing (CN); Jian Huo, Beijing (CN); Yanfang Wu, Beijing (CN); Shouding Li, Beijing (CN); Xiao Li, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 17/248,910

(22) Filed: Feb. 12, 2021

(65) Prior Publication Data

US 2022/0136352 A1 May 5, 2022

(30) Foreign Application Priority Data

Nov. 4, 2020 (CN) ..... 202011213179.0

(51) Int. Cl.
*E21B 25/08* (2006.01)
*E21B 25/00* (2006.01)

(52) U.S. Cl.
CPC ..... *E21B 25/08* (2013.01); *E21B 25/005* (2013.01)

(58) Field of Classification Search
None
See application file for complete search history.

(56) References Cited

U.S. PATENT DOCUMENTS

| | | | | |
|---|---|---|---|---|
| 3,548,958 | A * | 12/1970 | Rumble | E21B 25/08 175/242 |
| 6,216,804 | B1 * | 4/2001 | Aumann | E21B 25/08 175/246 |
| 9,376,879 | B2 * | 6/2016 | Mizuguchi | E21B 25/005 |
| 2008/0066534 | A1 * | 3/2008 | Reid | E21B 49/06 73/152.13 |
| 2009/0166088 | A1 * | 7/2009 | Jeffryes | E21B 47/09 175/50 |
| 2013/0037539 | A1 * | 2/2013 | Graterol | E21B 25/02 53/467 |

(Continued)

*Primary Examiner* — Kipp C Wallace
(74) *Attorney, Agent, or Firm* — Mark T. Vogelbacker; Eckert Seamans Cherin & Mellott, LLC

(57) ABSTRACT

A device and a method for transferring and storing a deep in-situ core in a sealed and pressure-maintaining manner includes a pressure vessel, a sealed storage vessel, a control system, a pressure regulation system and at least one spherical valve. The pressure vessel includes a first barrel and a first end sealing piston mounted at a first end of the first barrel and being slidable in the pressure vessel. The sealed storage vessel includes a second barrel and a second end sealing piston which is mounted at a first end of the second barrel. At least one spherical valve is connected between the first barrel and the second barrel. The pressure regulation system is configured for regulating an amount of water in the second barrel. The control system includes a first pressure sensor, a second pressure sensor, and a controller.

3 Claims, 2 Drawing Sheets

(56) References Cited

U.S. PATENT DOCUMENTS

| | | | | |
|---|---|---|---|---|
| 2013/0233622 | A1* | 9/2013 | Reid | E21B 25/10 175/58 |
| 2018/0245415 | A1* | 8/2018 | Jones | E21B 34/06 |
| 2021/0123344 | A1* | 4/2021 | Westacott | E21B 49/0875 |

* cited by examiner

DEVICE AND METHOD FOR TRANSFERRING AND STORING A DEEP IN-SITU CORE IN A SEALED AND PRESSURE-MAINTAINING MANNER

CROSS REFERENCE TO RELATED APPLICATION

This application claims the priority of Chinese Patent Application No. 202011213179.0, entitled "DEVICE AND METHOD FOR TRANSFERRING AND STORING A DEEP IN-SITU CORE IN A SEALED AND PRESSURE-MAINTAINING MANNER" filed with the Chinese Patent Office on Nov. 4, 2020, which is incorporated herein by reference in its entirety.

TECHNICAL FIELD

The application relates to the technical field of energy exploration, and in particular to a device and method for transferring and storing a deep in-situ core in a sealed and pressure-maintaining manner.

BACKGROUND ART

In the development of unconventional energy, it is necessary to analyze a mineability of a reservoir and optimize a development process. By investigating in-situ cores in a laboratory, a porosity fracture structure and an organic matter content in a reservoir rock are evaluated. After being drilled at a bottom of a drilling, a deep in-situ core is sealed and maintained at a pressure by a pressure vessel and lifted to the surface, the core is transported quickly to the laboratory in a sealed and pressure-maintaining state, the core in the sealed and pressure-maintaining state is transferred and stored in the laboratory in a pressure-maintaining manner. The core of the reservoir is observed and tested deeply to obtain various key parameters, and a reasonable evaluation of the mineability and a design and optimization of the reservoir reconstruction project are carried out on the reservoir. Therefore, after the in-situ core is obtained in the deep formation, it is particularly important to seal and maintain the in-situ core at a pressure in a process of storage and transfer. In the current technology of sealing and maintaining the core at a pressure, the sealed and pressure-maintaining effect of the pressure vessel is poor, pressure leakage occurs in the process of the transfer and storage over time, and it is difficult to maintain the core in an in-situ pressure state in the process of the transfer and storage, resulting in a large deviation between a test value and a actual in-situ value which affects the evaluation of the mineability and the design and optimization of the reservoir reconstruction project of the reservoir. Therefore, it is a technical problem to be solved by a person skilled in the art to provide a device for transferring and storing a deep in-situ core with a good sealed and pressure-maintaining effect.

SUMMARY

The embodiments aim to provide a device and method for transferring and storing a deep in-situ core in a sealed and pressure-maintaining manner, which are intended to solve the technical problem that a sealed and pressure-maintaining effect of existing storage and transfer devices is poor and the accuracy of test values is influenced negatively.

In order to achieve the above-mentioned purpose, the present disclosure provides the following solutions.

The present disclosure provides a device for transferring and storing a deep in-situ core in a sealed and pressure-maintaining manner. The device may include: a pressure vessel, comprising a first barrel and a first end sealing piston mounted at a first end of the first barrel, and the first end sealing piston being slidable in the pressure vessel; a sealed storage vessel, comprising a second barrel and a second end sealing piston which is mounted at a first end of the second barrel; at least one spherical valve, connected between the first barrel and the second barrel; a pressure regulation system, configured for regulating an amount of water in the second barrel; and a control system, comprising: a first pressure sensor configured for sensing a first pressure in the first barrel, a second pressure sensor configured for sensing a second pressure in the second barrel and a controller, wherein the first pressure sensor and the second pressure sensor are both electrically connected to an input end of the controller, and an output end of the controller is electrically connected to the pressure regulation system.

In some embodiments, the at least one spherical valve is two spherical valves, comprising a first spherical valve adjacent to the pressure vessel and a second spherical valve adjacent to the sealed storage vessel.

In some embodiments, the pressure regulation system comprises: a first pressure regulation system which comprises a first valve mounted in a first pipeline, a second valve mounted in a second pipeline, a third valve and an overflow valve mounted in the third pipeline, a plunger servo pump and a pressure-bearing deionized water tank, a first end of the first pipeline is in connection with the second barrel, a first end of the second pipeline and a first end of the third pipeline are both in connection with a second end of the first pipeline, a second end of the second pipeline is connected to a water outlet of the plunger servo pump, a water inlet of the plunger servo pump is connected to the pressure-bearing deionized water tank through a fourth pipeline, a second end of the third pipeline is in connection with the pressure-bearing deionized water tank, the overflow valve is closer to the pressure-bearing deionized water tank than the third valve, an input end of the plunger servo pump is electrically connected to an output end of the controller and the second pressure sensor is configured to sense the second pressure at the water outlet of the plunger servo pump.

In some embodiments, the device may further include a second pressure regulation system which comprises a third pressure sensor configured for sensing a third pressure in the second barrel, a fourth valve mounted in the fourth pipeline and a high pressure accumulator, a first end of the fourth pipeline is in connection with the second barrel, and a second end of the fourth pipeline is in connection with a bottom of the high pressure accumulator.

The present disclosure further provides a method for transferring and storing a deep in-situ core in a sealed and pressure-maintaining manner, the method may include the following steps of:

S1, separating a structure consisting of the pressure vessel and the first spherical valve from a integral structure, placing an in-situ core taken from a deep formation under a fourth pressure into the pressure vessel, and filling the first spherical valve with underground water having a fifth pressure same as the fourth pressure of the in-situ core, closing the first spherical valve, reconnecting the first spherical valve with the second spherical valve to reconnect the structure consisting of the pressure vessel and the first spherical valve to the integral structure;

S2, opening the first valve, the second valve and the fourth valve, and controlling the plunger servo pump by the controller to pump pressure-bearing deionized water in the pressure-bearing deionized water tank into the second barrel so that the second pressure of the second pressure sensor reaches to and is maintained at a value of the first pressure of the first pressure sensor, after pressure equalization, sequentially opening the second spherical valve and the first spherical valve, controlling the plunger servo pump by the controller to pump the pressure-bearing deionized water in the pressure-bearing deionized water tank into the second barrel so that the second pressure of the second pressure sensor reaches and is maintained at the value of the first pressure of the first pressure sensor to enable a communication between the second barrel and the first barrel under pressure equalization;

S3, closing the second valve and the fourth valve, and opening the third valve to allow the pressure-bearing deionized water in the second barrel flow back into the pressure-bearing deionized water tank through the first valve, the third valve and the overflow valve, pushing the first end sealing piston to drive the in-situ core to move through the first spherical valve and the second spherical valve sequentially and into the sealed storage vessel, pushing the first end sealing piston to drive the in-situ core to enter the second barrel, closing the first spherical valve and the second spherical valve, and closing the first valve;

S4, removing the pressure vessel, the first spherical valve, the first pipeline, the second pipeline and the third pipeline, remaining the second barrel in connection with the high-pressure accumulator, opening the fourth valve, and controlling the high-pressure accumulator to supply water and boost pressure for the second barrel by observing the third pressure in the second barrel sensed by the third pressure sensor, so as to maintain the second barrel at an initial pressure to which the in-situ core is exposed upon being placed into the pressure vessel.

Compared with the conventional art, the embodiments have the following technical effects.

The device for transferring and storing a deep in-situ core in a sealed and pressure-maintaining manner according to the present disclosure includes a pressure vessel, a sealed storage vessel, a pressure regulation system, a control system and at least one spherical valve. After the in-situ core is obtained in the deep formation, the in-situ core is placed into the first barrel, and the in-situ core can be sealed and maintained at a pressure by the first end sealing piston and the spherical valve. By opening the spherical valve, the in-situ core can be completely entered into the second barrel after passing through the spherical valve, then the spherical valve is closed, and the transferred in-situ core can be sealed and maintained at the pressure by the spherical valve and the second end sealing piston, and the sealed and pressure-maintaining effect is good. The controller receives a pressure values transmitted by the first pressure sensor and the second pressure sensor, and controls the pressure regulation system to regulate the amount of water in the second barrel, so as to maintain a constant pressure during the transfer of the in-situ core from the pressure vessel to the sealed storage vessel. An initial pressure state of the in-situ core is maintained, and an accuracy of a test result is improved.

BRIEF DESCRIPTION OF THE DRAWINGS

In order to more clearly illustrate embodiments of the present disclosure or the technical solutions in the conventional art, drawings used in the embodiments will be briefly described below. It is apparent that the drawings in the following description are only some embodiments of the present disclosure, and those skilled in the art can obtain other drawings according to the drawings without creative efforts.

Figure 1:
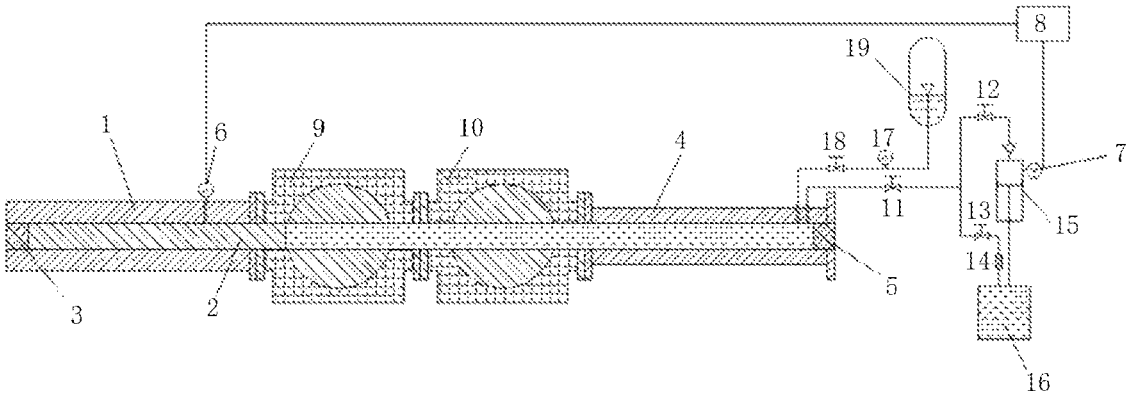
FIG. 1 is a schematic structural diagram of an device for transferring and storing a deep in-situ core in a sealed and pressure-maintaining manner according to an embodiment of the present invention.

List of the reference characters: 1 first barrel; 2 in-situ core; 3 first end sealing piston; 4 second barrel; 5 second end sealing piston; 6 first pressure sensor; 7 second pressure sensor; 8 controller; 9 first spherical valve; 10 second spherical valve; 11 first valve; 12 second valve; 13 third valve; 14 overflow valve; 15 plunger servo pump; 16 pressure-bearing deionized water tank; 17 third pressure sensor; 18 fourth valve; 19 high pressure accumulator.

DETAILED DESCRIPTION OF THE EMBODIMENTS

The technical solutions in the embodiments of the present disclosure will be clearly and completely described below with reference to the drawings in the embodiments of the present disclosure. It is apparent that the described embodiments are only a part of the embodiments of the present disclosure, and not all of the embodiments. All other embodiments, which can be obtained by those skilled in the art without inventive effort based on the embodiments of the present disclosure, are within the scope of protection of the present disclosure.

In order to make the above-mentioned objects, features and advantages of the present disclosure more comprehensible, the present disclosure is described in detail with reference to the accompanying drawings and particular embodiments.

Figure 2:
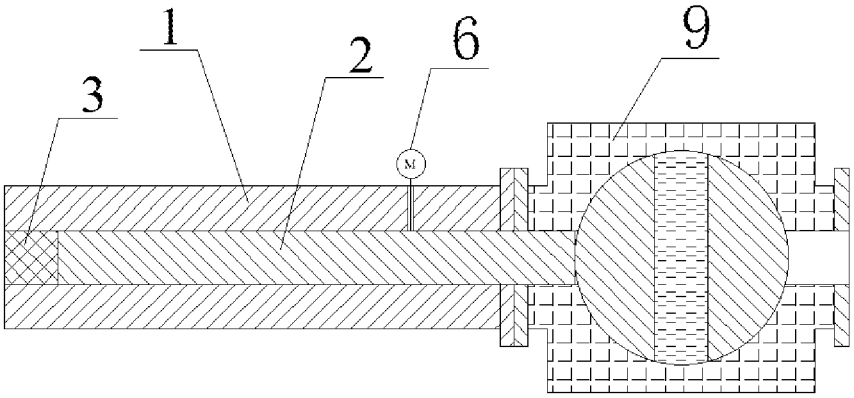
FIG. 2 is a schematic structural diagram of a pressure vessel before transferring the in-situ core.
Figure 3:
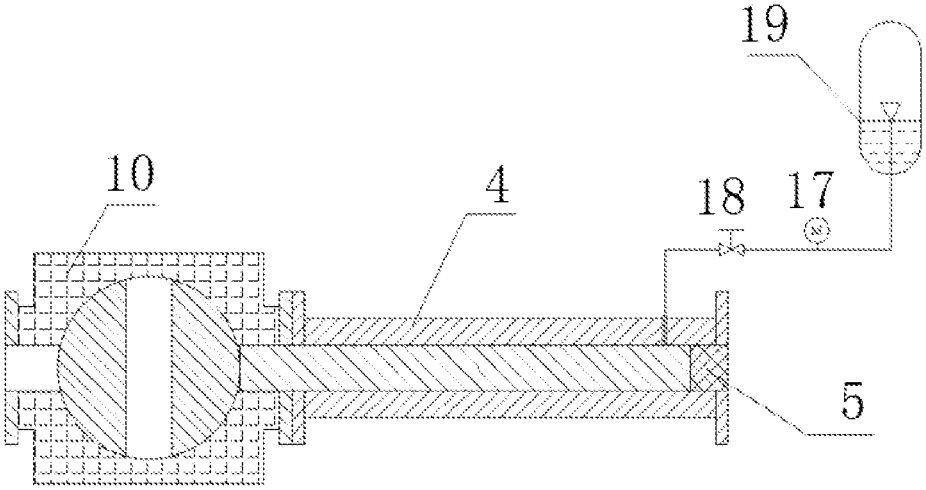
FIG. 3 is a structural schematic diagram of a sealed storage vessel after transferring the in-situ core.

As shown in FIGS. 1-3, the present embodiment provides a device for transferring and storing a deep in-situ core in a sealed and pressure-maintaining manner, includes a pressure vessel, a sealed storage vessel, a pressure regulation system, a control system and at least one spherical valve.

The pressure vessel includes a first barrel 1 and a first end sealing piston 3, and the first end sealing piston 3 is mounted at a first end of the first barrel 1 and is slidable in the pressure vessel. The sealed storage vessel includes a second barrel 4 and a second end sealing piston 5, and the second end sealing piston 5 is mounted at a first end of the second barrel 4. The at least one spherical valve is connected between the first barrel 1 and the second barrel 4. The pressure regulation system is configured for regulating an amount of water in the second barrel 4. The control system includes a first pressure sensor 6, a second pressure sensor 7 and a controller 8, the first pressure sensor 6 is configured for sensing a pressure in the first barrel 1, the second pressure sensor 7 is configured for sensing a pressure in the second barrel 4, the first pressure sensor 6 and the second pressure sensor 7 are both electrically connected to an input end of the controller 8, and an output end of the controller 8 is electrically connected to the pressure regulation system.

In the present embodiment, after the in-situ core 2 is obtained in the deep formation, the in-situ core 2 is placed into the first barrel 1, and the in-situ core 2 can be sealed and maintained at a pressure by the first end sealing piston 3 and the spherical valve. By opening the spherical valve, the in-situ core 2 can be completely entered into the second barrel 4 through the spherical valve, then the spherical valve is closed, and the transferred in-situ core 2 can be sealed and maintained at the pressure by the spherical valve and the second end sealing piston 5, and the sealed and pressure-maintaining effect is good. The controller 8 receives pressure values transmitted from the first pressure sensor 6 and the second pressure sensor 7, and controls the pressure regulation system to regulate the amount of water in the second barrel 4, so as to maintain a constant pressure during the transfer from the pressure vessel to the sealed storage vessel, thus an initial pressure state of the in-situ core 2 is remained, and an accuracy of a test result is improved.

In the present embodiment, a number of the spherical valve is preferably two, including a first spherical valve 9 adjacent to the pressure vessel and a second spherical valve 10 adjacent to the sealed storage vessel. The first spherical valve 9 is detachably connected with the second spherical valve 10. After the transfer of the in-situ core 2, the first spherical valve and the second spherical valve can be quickly separated. The separation operation is simple, and thus a transfer efficiency of the in-situ core 2 is improved.

There are a variety of pressure regulation systems, and a person skilled in the art can choose one according to actual needs. In the present embodiment, the pressure regulation system includes a first pressure regulation system. The first pressure regulation system includes a first valve 11, a second valve 12, a third valve 13, an overflow valve 14, a plunger servo pump 15 and a pressure-bearing deionized water tank 16. The first valve 11 is mounted in a first pipeline, and the second valve 12 is mounted in a second pipeline. The third valve 13 and the overflow valve 14 are mounted in a third pipeline. A first end of the first pipeline is in connection with the second barrel 4. A first end of the second pipeline and a first end of the third pipeline are both in connection with a second end of the first pipeline. A second end of the second pipeline is connected to a water outlet of the plunger servo pump 15. A water inlet of the plunger-type servo pump 15 is connected to the pressure-bearing deionized water tank 16 through a fourth pipeline. A second end of the third pipeline is in connection with the pressure-bearing deionized water tank 16. The overflow valve 14 is closer to the pressure-bearing deionized water tank 16 than the third valve 13. An input end of the plunger servo pump 15 is electrically connected to an output end of the controller 8. The second pressure sensor 7 is configured to sense a pressure at the water outlet of the plunger servo pump 15. The pressure of the in-situ core 2 can be maintained constant during the transfer process, so that the in-situ core 2 is always maintained in the initial state, thereby ensuring the accuracy of the test result.

In order to avoid influencing the accuracy of the test result due to slow pressure leakage of the device when storing the in-situ core 2, the present embodiment further includes a second pressure regulation system. The second pressure regulation system includes a third pressure sensor 17, a fourth valve 18 and a high pressure accumulator 19. The fourth valve 18 is mounted in the fourth pipeline, and a first end of the fourth pipeline is in connection with the second barrel 4. A second end of the fourth pipeline is in connection with a bottom of the high pressure accumulator 19. The third pressure sensor 17 is configured for sensing a pressure in the second barrel 4. When the in-situ core 2 is stored, the pressure in the second barrel is monitored by the third pressure sensor 17, and the pressure in the second barrel 4 is regulated by the high-pressure accumulator 19, and the pressure suffered by the in-situ core 2 is maintained constant.

The present embodiment further provides a method for using the above-mentioned device, the method includes steps S1 to S4.

In step S1, a structure consisting of the pressure vessel and the first spherical valve 9 is separated from a integral structure, an in-situ core 2 taken from a deep formation under a pressure is placed into the pressure vessel, and the first spherical valve 9 is filled with underground water in a same pressure state as that of the in-situ core 2. Then the first spherical valve 9 is closed, the first spherical valve 9 is reconnected with the second spherical valve 10 so as to reconnect the structure consisting of the pressure vessel and the first spherical valve 9 to the integral structure.

In step S2, the first valve 11, the second valve 12 and the fourth valve 18 are opened, and the plunger servo pump 15 is controlled by the controller 8 to pump pressure-bearing deionized water in the pressure-bearing deionized water tank 16 into the second barrel 4, so that a pressure of the second pressure sensor 7 reaches to and is maintained at a pressure value of the first pressure sensor 6. After pressure equalization, the second spherical valve 10 and the first spherical valve 9 are sequentially opened, then the plunger servo pump 15 is controlled by the controller 8 to pump the pressure-bearing deionized water in the pressure-bearing deionized water tank 16 into the second barrel 14, so that the pressure of the second pressure sensor 7 reaches to and is maintained at the pressure value of the first pressure sensor 6 to enable a communication between the second barrel 4 and the first barrel 1 under pressure equalization.

In step S3, the second valve 12 and the fourth valve 18 are closed, and the third valve 13 is opened, the first end sealing piston 3 is pushed to drive the in-situ core 2 to move, the in-situ core 2 passes through the first spherical valve 9 and the second spherical valve 10 sequentially and then enters the sealed storage vessel, the pressure-bearing deionized water in the second barrel 4 flows back into the pressure-bearing deionized water tank 16 through the first valve 11, the third valve 13 and the overflow valve 14, to push the first end sealing piston 3 so that the in-situ core 2 enters the second barrel 4. Then, the first spherical valve 9 and the second spherical valve 10 are closed, and the first valve 11 is closed.

In step S4, the pressure vessel, the first spherical valve 9, the first pipeline, the second pipeline and the third pipeline are removed, the second barrel 4 remains in connection with the high-pressure accumulator 19, and the fourth valve 18 is opened. The high-pressure accumulator 19 is controlled to supply water and boost pressure for the second barrel 4 by observing a pressure in the second barrel 4 which is sensed by the third pressure sensor 17, so as to maintain the second barrel 4 at the initial pressure to which the in-situ core 2 is exposed upon being placed into the pressure vessel.

The principle and the embodiments of the present disclosure are explained by using specific examples in the present specification, and the above description of the embodiments is only used to help understand the method and the core idea of the present disclosure. Furthermore, according to the idea of the present disclosure, a person skilled in the art may change the specific embodiments and the application range. In summary, the description is not to be taken in a limiting sense.

What is claimed is:

1. A device for transferring and storing a deep in-situ core in a sealed and pressure-maintaining manner, the device comprising:

a pressure vessel comprising a first barrel and a first end sealing piston mounted at a first end of the first barrel, and the first end sealing piston being slidable in the pressure vessel;

a sealed storage vessel comprising a second barrel and a second end sealing piston which is mounted at a first end of the second barrel;

at least one spherical valve connected between the first barrel and the second barrel;

a pressure regulation system configured for regulating an amount of water in the second barrel; and a control system comprising: a first pressure sensor configured for sensing a first pressure in the first barrel, a second pressure sensor configured for sensing a second pressure in the second barrel and a controller, wherein the first pressure sensor and the second pressure sensor are both electrically connected to an input end of the controller, and an output end of the controller is electrically connected to the pressure regulation system, wherein the at least one spherical valve is two spherical valves comprising a first spherical valve adjacent to the pressure vessel and a second spherical valve adjacent to the sealed storage vessel, and wherein the pressure regulation system comprises: a first pressure regulation system which comprises a first valve mounted in a first pipeline, a second valve mounted in a second pipeline, a third valve and an overflow valve mounted in the third pipeline, a plunger servo pump and a pressure-bearing deionized water tank, a first end of the first pipeline is in connection with the second barrel, a first end of the second pipeline and a first end of the third pipeline are both in connection with a second end of the first pipeline, a second end of the second pipeline is connected to a water outlet of the plunger servo pump, a water inlet of the plunger servo pump is connected to the pressure-bearing deionized water tank through a fourth pipeline, a second end of the third pipeline is in connection with the pressure-bearing deionized water tank, the overflow valve is closer to the pressure-bearing deionized water tank than the third valve, an input end of the plunger servo pump is electrically connected to an output end of the controller and the second pressure sensor is configured to sense the second pressure at the water outlet of the plunger servo pump.

2. The device for transferring and storing a deep in-situ core in a sealed and pressure-maintaining manner according to claim 1, wherein the pressure regulation system further comprises a second pressure regulation system which comprises a third pressure sensor configured for sensing a third pressure in the second barrel, a fourth valve mounted in the fourth pipeline and a high pressure accumulator, a first end of the fourth pipeline is in connection with the second barrel, and a second end of the fourth pipeline is in connection with a bottom of the high pressure accumulator.

3. A method for transferring and storing of a deep in-situ core in a sealed and pressure-maintaining manner using the device for transferring and storing a deep in-situ core in a sealed and pressure-maintaining according to claim 1, the method comprising the following steps of:

(Step 1) separating a structure consisting of the pressure vessel and the first spherical valve from an integral structure, placing an in-situ core taken from a deep formation under a fourth pressure into the pressure vessel, and filling the first spherical valve with underground water having a fifth pressure same as the fourth pressure of the in-situ core, closing the first spherical valve, reconnecting the first spherical valve with the second spherical valve to reconnect the structure consisting of the pressure vessel and the first spherical valve to the integral structure;

(Step 2) opening the first valve, the second valve and a fourth valve of a second pressure regulation system and mounted in the fourth pipeline, wherein the second pressure regulation system is part of the pressure regulation system, and controlling the plunger servo pump by the controller to pump pressure-bearing deionized water in the pressure-bearing deionized water tank into the second barrel so that the second pressure of the second pressure sensor reaches to and is maintained at a value of the first pressure of the first pressure sensor, after pressure equalization, sequentially opening the second spherical valve and the first spherical valve, controlling the plunger servo pump by the controller to pump the pres sure-bearing deionized water in the pressure-bearing deionized water tank into the second barrel so that the second pressure of the second pressure sensor reaches and is maintained at the value of the first pressure of the first pressure sensor to enable a communication between the second barrel and the first barrel under pressure equalization;

(Step 3) closing the second valve and the fourth valve, and opening the third valve to allow the pressure-bearing deionized water in the second barrel flow back into the pressure-bearing deionized water tank through the first valve, the third valve and the overflow valve, pushing the first end sealing piston to drive the in-situ core to move through the first spherical valve and the second spherical valve sequentially and into the sealed storage vessel, pushing the first end sealing piston to drive the in-situ core to enter the second barrel, closing the first spherical valve and the second spherical valve, and closing the first valve; and (Step 4) removing the pressure vessel, the first spherical valve, the first pipeline, the second pipeline and the third pipeline, remaining the second barrel in connection with a high-pressure accumulator of the second pressure regulation system, opening the fourth valve, and controlling the high-pressure accumulator to supply water and boost pressure for the second barrel by observing the third pressure in the second barrel sensed by the third pressure sensor, so as to maintain the second barrel at an initial pressure to which the in-situ core is exposed upon being placed into the pressure vessel.

* * * * *